US005270785A

United States Patent [19]

Kita et al.

[11] Patent Number: 5,270,785

[45] Date of Patent: Dec. 14, 1993

[54] TONER HOPPER

[75] Inventors: Hideki Kita, Suita; Toshimitsu Takeuchi, Hirakata, both of Japan

[73] Assignee: Mita Industrial Co., Ltd., Osaka, Japan

[21] Appl. No.: 909,740

[22] Filed: Jul. 7, 1992

[30] Foreign Application Priority Data

Jul. 15, 1991 [JP] Japan ..... 3-173584

[51] Int. Cl.[5] ..... G03G 15/06

[52] U.S. Cl. ..... 355/260; 222/DIG. 1; 355/245

[58] Field of Search ..... 355/246, 260, 245; 222/DIG. 1

[56] References Cited

U.S. PATENT DOCUMENTS

| | | | |
|---|---|---|---|
| 4,647,180 | 3/1987 | Watanabe | 355/260 |
| 4,993,829 | 2/1991 | Naganuma et al. | 355/245 X |
| 5,075,728 | 12/1991 | Kobayashi et al. | 355/260 |

OTHER PUBLICATIONS

Xerox Disclosure Journal, vol. 8 No. 5, Oscar G. Hauser et al., "Toner Bridging Prevention Device," Nov.-Dec. 1983, pp. 511-512.

Xerox Disclosure Journal, vol. 14, No. 6, A. Bhaqwat, "Toner Bridging Demolition Device," Nov.-Dec. 1989, pp. 305-306.

Patent Abstracts of Japan, vol. 7, No. 127 (P-201) (1272), Jun. 3, 1983 to Tomura, which relates to Japanese Patent Publication No. 58-43477.

Xerox Disclosure Journal, vol. 6, No. 6, Herbert H. Ammenheuser et al., "Internal Agitator-Dispensing Bottle," Nov.-Dec. 1981, pp. 325-326.

Patent Abstracts of Japan, vol. 7, No. 206 (P-222) (1351) Sep. 10, 1983 to Ishii, which relates to Japanese Patent Publication No. 58-102269.

*Primary Examiner*—Leo P. Picard

*Assistant Examiner*—Christopher Horgen

*Attorney, Agent, or Firm*—Beveridge, DeGrandi, Weilacher & Young

[57] ABSTRACT

A vibrating member (3) having an elasticity is provided in which an end (A) is mounted to a rotating part (6) in a toner conveying section (4) and which has a size such that the other end (B) thereof extends far beyond the tip of a blade (5) of the rotating part (6), whereby the rotation of the rotating part (6) causes the other end (B) of the vibrating member (3) to collide with the opening or inner wall of a toner cartridge (1). This collision allows a toner to drop efficiently, prevent the toner from being blocked, and noise to be reduced.

17 Claims, 8 Drawing Sheets

TONER HOPPER

BACKGROUND OF THE INVENTION

1. Field of the Invention

The present invention relates to a toner hopper for supplying a toner to a developer of an image forming apparatus.

2. Related Art of the Invention

Where heretofore a toner cartridge 1 is mounted on a toner conveying section 4 to use, as shown in FIG. 1, a toner 33 in the toner cartridge 1 drops naturally and goes into a casing 34 of the toner conveying section 4. The toner 33 in the casing 34 is conveyed to a developer side from an exit 35 by blades 5 rotating in the arrow direction. When the toner 33 has been fed to the developer side to cause the toner 33 in the casing 34 to become less in quantity, the toner 33 drops from the toner cartridge 1 and is supplemented in the casing 34.

At this point, if the toner 33 adheres to and remains on the inner wall of the toner cartridge 1, or the toner 33 does not drop smoothly, a tapping bar 30 provided outside the toner cartridge 1 is allowed to be driven by a spiral drive section (not shown) with a pivot shaft 32 as a center, whereby the outer wall of the toner cartridge 1 is tapped by a head 31 of the tapping bar 30 to give a vibration, making easy the drop of the toner 33.

However, the method of tapping the outer wall of the toner cartridge 1 to give a vibration as described above has problems that efficiency is not good, the toner 33 does not drop completely, and noise develops. Furthermore, when the toner 33 is blocked by the weight thereof, the toner 33 lumps increasingly.

SUMMARY OF THE INVENTION

Considering such problems of the prior art, an object of the present invention is to provide a toner hopper which drops a toner efficiently, prevents the toner from being blocked, and reduces noise.

That is, a toner hopper having a toner conveying section for supplying a toner in a toner cartridge of the present invention, comprises:

a vibrating member having an elasticity, an end A thereof being mounted to a rotating part in said toner conveying section and which has a size such that the other end B thereof extends far beyond a tip of a blade of said rotating part, and a rotation of said rotating part causing said other end B of said vibrating member to collide with an opening part or an inner wall of said toner cartridge.

In the present invention, a rotating part of a toner conveying section is rotated while a vibrating member mounted to the rotating part is rotated together, and an end B of the vibrating member extends far beyond the tip of a blade of the rotating part, and after passing through an opening of a toner cartridge, collides with the opening or outer wall of the toner cartridge, thereby allowing a toner in the toner cartridge to drop efficiently into the toner conveying section.

PREFERRED EMBODIMENTS OF THE INVENTION

With reference to drawings, embodiments of the present invention will be described hereinafter.

Figure 1:
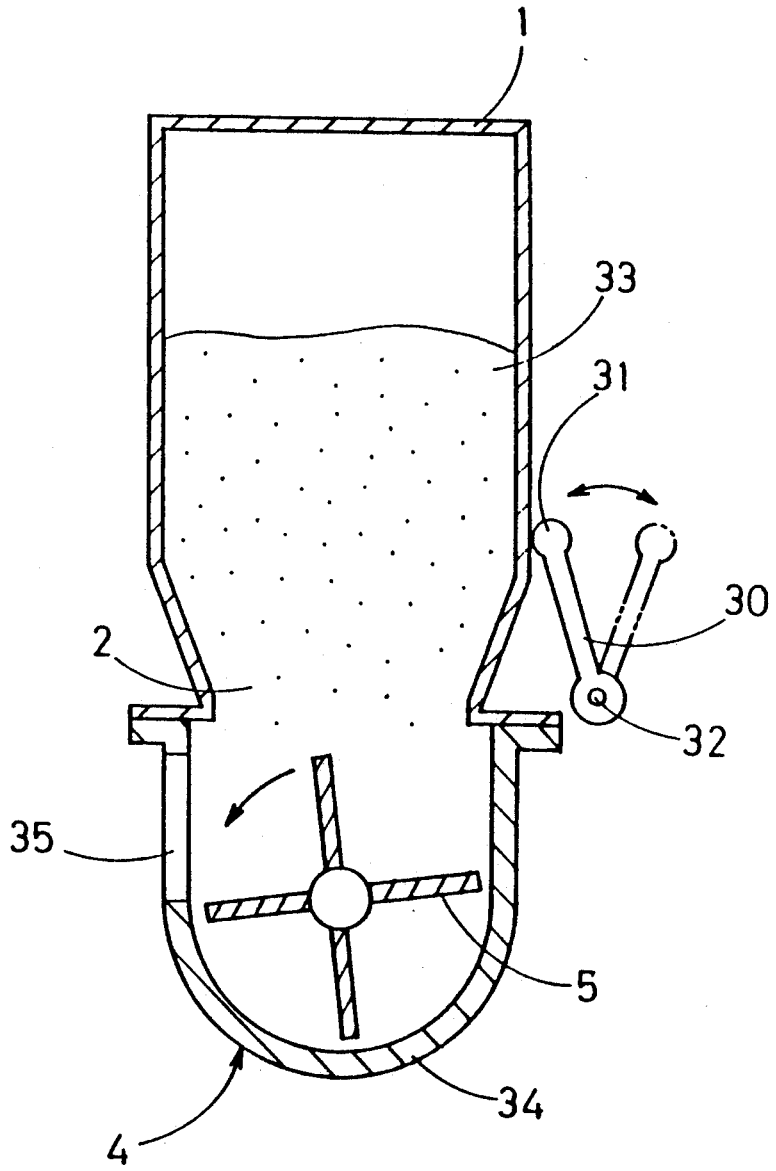
FIG. 1 (PRIOR ART)
FIG. 1 is a side sectional view of the toner hopper of prior art.
Figure 2:
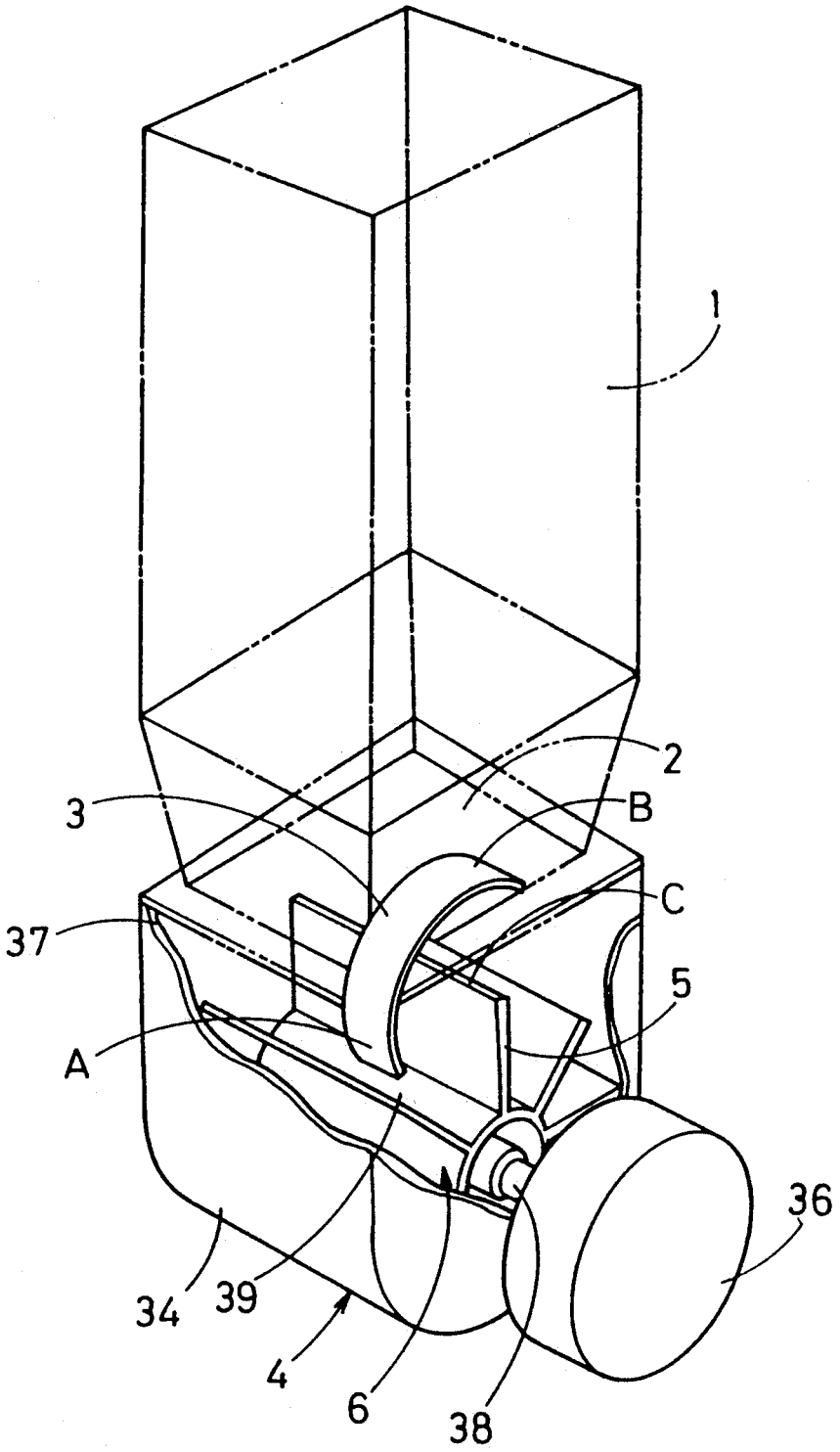
FIG. 2 is a perspective view of an embodiment of a toner hopper according to the present invention.

FIG. 2 is a perspective view of an embodiment of a toner hopper according to the present invention. That is, the toner hopper is provided with a toner conveying section 4. The toner conveying section 4 is provided with a casing 34, in which a rotating part 6 is provided. The rotating part 6 is provided with a shaft 38. The shaft 38 is connected to a motor 36 provided outside the casing 34. To the shaft 38 is fixed a hub 39. The hub 39 is provided with plural pieces of blades 5 in a radial manner, and mounted with an end A of a vibrating member 3. The vibrating member 3 is a lengthy plate and has a resiliency, for which polyester film, polyvinyl chloride film, or phosphor bronze, stainless sheet and the like are used as a material thereof. Of the shaft 38, the hub 39 and the blades 5, the rotating part 6 is composed. The other end B of the vibrating member 3 has an enough size to be in contact with the edge (part) 12 of an opening 2 of a toner cartridge 1 or an inner wall 13 of the toner cartridge 1.

The upper part of the casing 34 is open, and provided with a mounting part flange 37 for mounting the toner cartridge 1 to it. With the upper part opening aligned with the opening 2 of the toner cartridge 1, the toner cartridge 1 is mounted on the casing 34.

The operation of the above-described embodiment will be described hereinafter.

Figure 3:
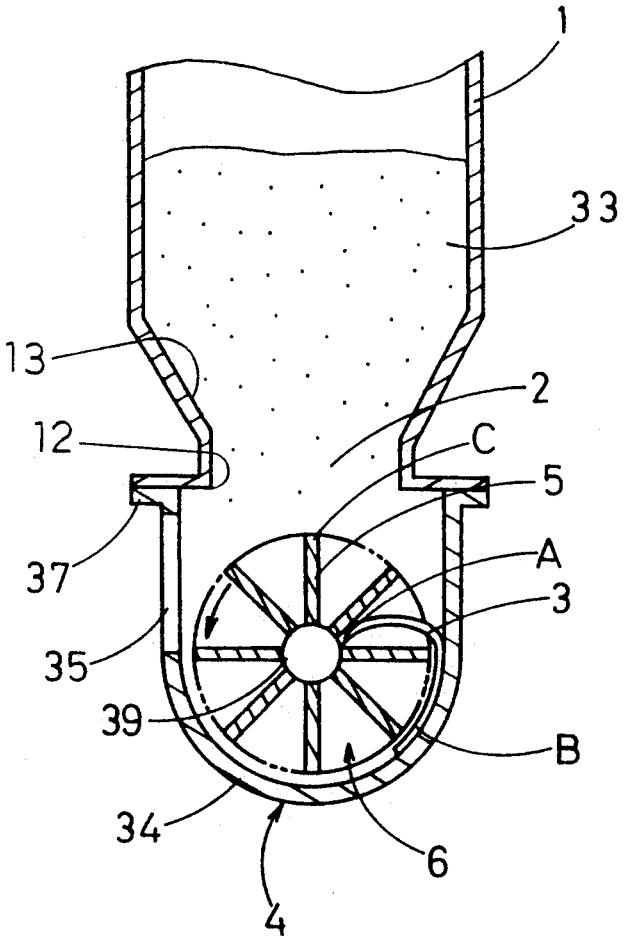
FIG. 3 is a side sectional view illustrating the operation of the embodiment.

First, as shown in FIG. 3, the toner cartridge 1 with the opening 2 faced down is allowed to be mounted to the mounting part (flange) 37 of the toner conveying section 4 and a cover seal of the opening 2 is removed. Then, a toner 33 in the toner cartridge 1 drops naturally and goes through the opening 2 into the casing 34. The toner 33 in the casing 34 is conveyed to a developer side from an exit 35 by blades 5 rotating in the arrow direction. Each time the toner 33 in the casing 34 is conveyed and decreased, the toner 33 drops from the toner cartridge 1 and is supplemented.

Figure 4:
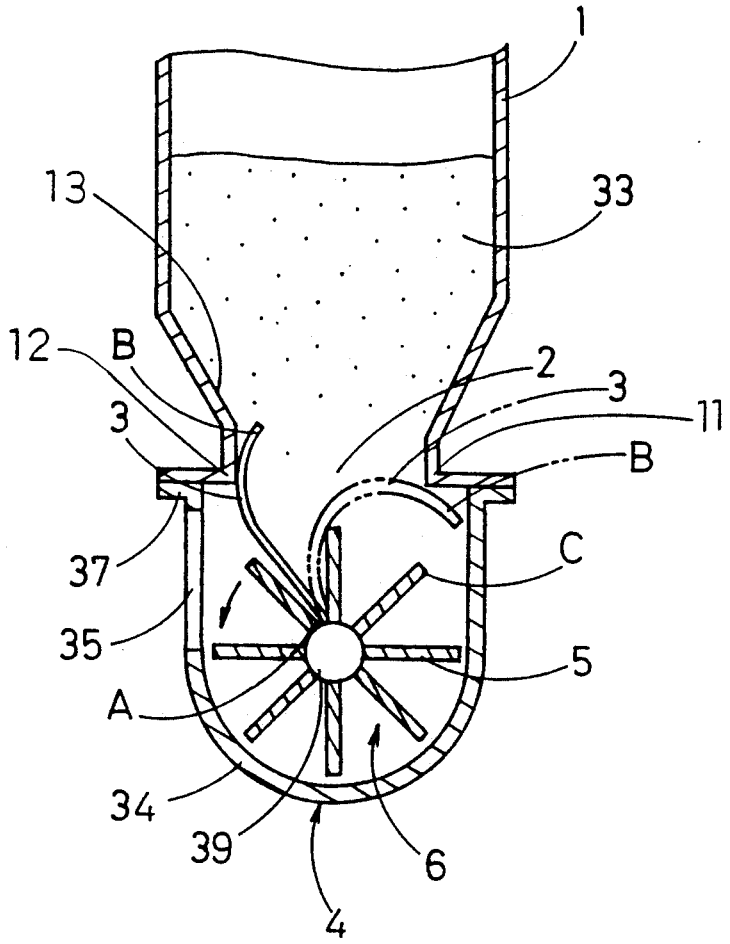
FIG. 4 is a side sectional view of another state illustrating the operation of the embodiment.

Now, the vibrating member 3 mounted to the hub 39 of the rotating part 6, with the end B thereof bent in the direction opposite to that of rotation, starts to rotate along the inner wall 13 of the casing 34. Then, as shown in FIG. 4, the tip of the end B comes in contact with an edge 11 of the opening 2 of the toner cartridge 1 (cf.the two-dot chain line in FIG. 4), and when by further rotation, the end B of the vibrating member 3 becomes away from the edge 11 of the opening 2, the force holding the end B is released, whereby the restoration and rotation forces of the vibrating member 3 cause the vibrating member 3 to be repulsed in the rotating direction and the end B thereof to collide with an edge 12 or an inner wall 13 of the opening 2 of the toner cartridge 1 (cf.the solid line in FIG. 4).

The impact at this point causes the toner 33 adhering to the inner wall 13 of the toner cartridge 1 to be dropped, and the vibrating member 3, when passing through the opening 2, agitates the toner 33 near the opening 2 to accelerate the drop of the toner 33.

Thus, for each rotation, the vibrating member 3 passes through the opening 2 of the toner cartridge 1 to collide with the edge 12 or the inner wall 13 of the opening 2, making easy the supply of the toner 33.

Although the vibrating member 3 of the above-described embodiment is one piece, it will be appreciated that a plurality of the members may be mounted.

Figure 5:
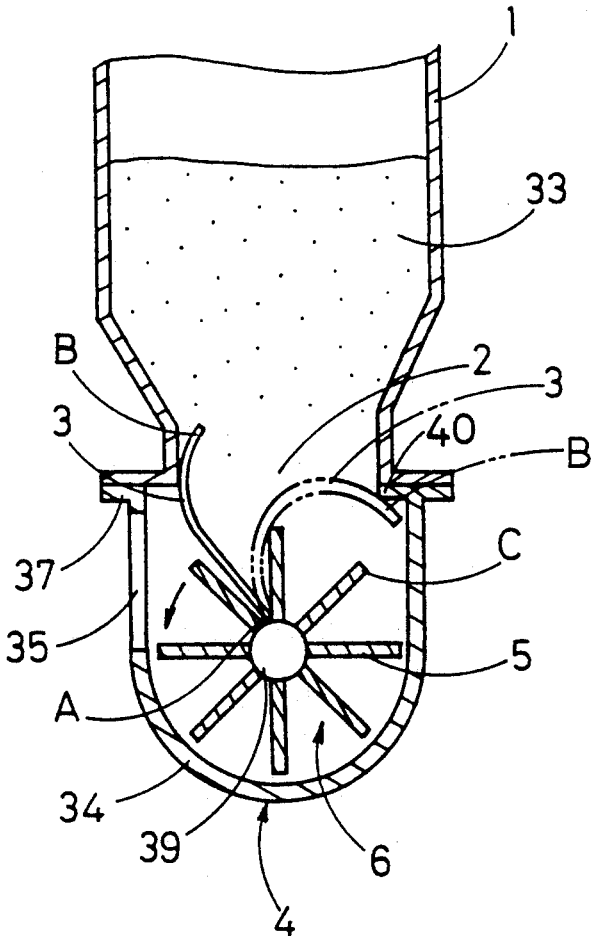
FIG. 5 is a side sectional view of another state illustrating the operation of the embodiment.
Figure 6:
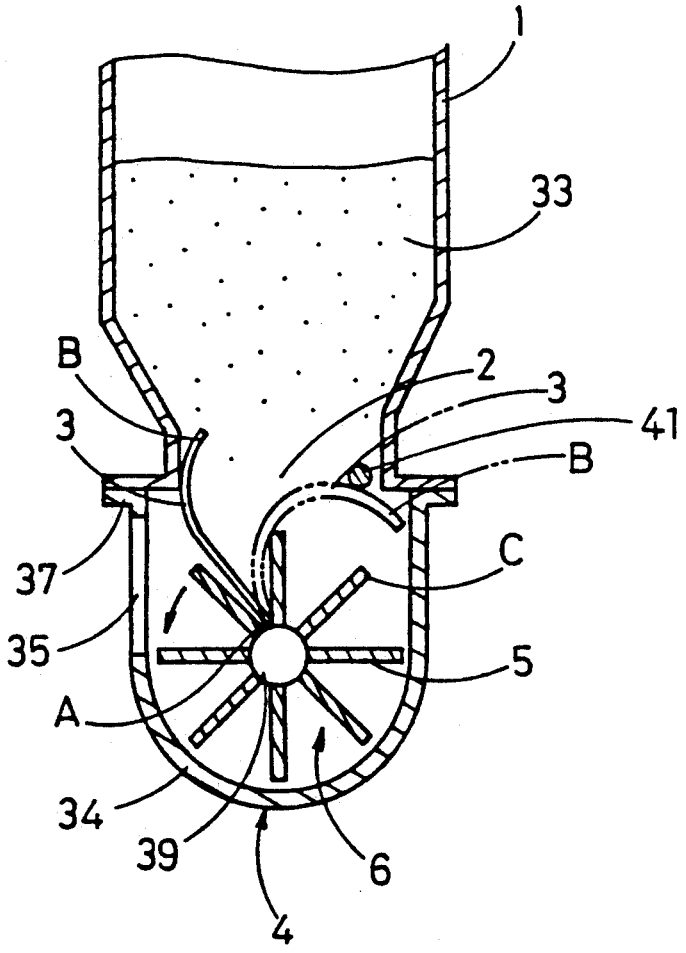
FIG. 6 is a side sectional view of another state illustrating the operation of the embodiment.

The vibrating member 3 may be such that the member 3 is held by an inner wall 40 of the toner conveying section 4 as shown in FIG. 5, or by an abutting member 41 near the opening 2 of the toner cartridge 1 as shown in FIG. 6, thereby storing a repulsing force. The abutting member 41 may be fixed to the toner cartridge 1 side, or to the toner conveying section 4 side.

Figure 7:
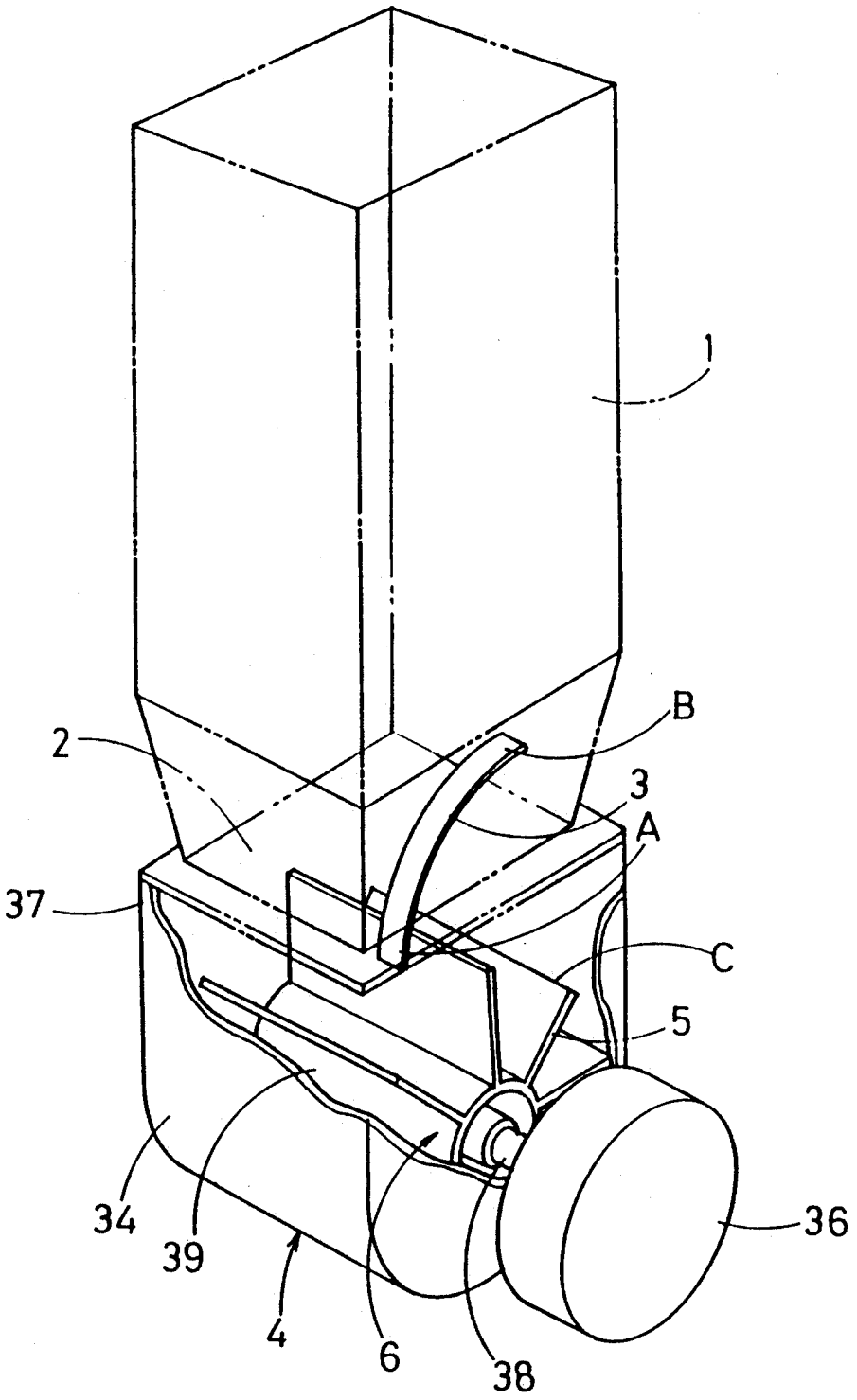
FIG. 7 is a perspective view of another embodiment.

Although the vibrating member 3 is mounted to the hub 39 in the above-described embodiment, the member 3 may be mounted to a tip C of the blade 5 as shown in FIG. 7.

Figure 8:
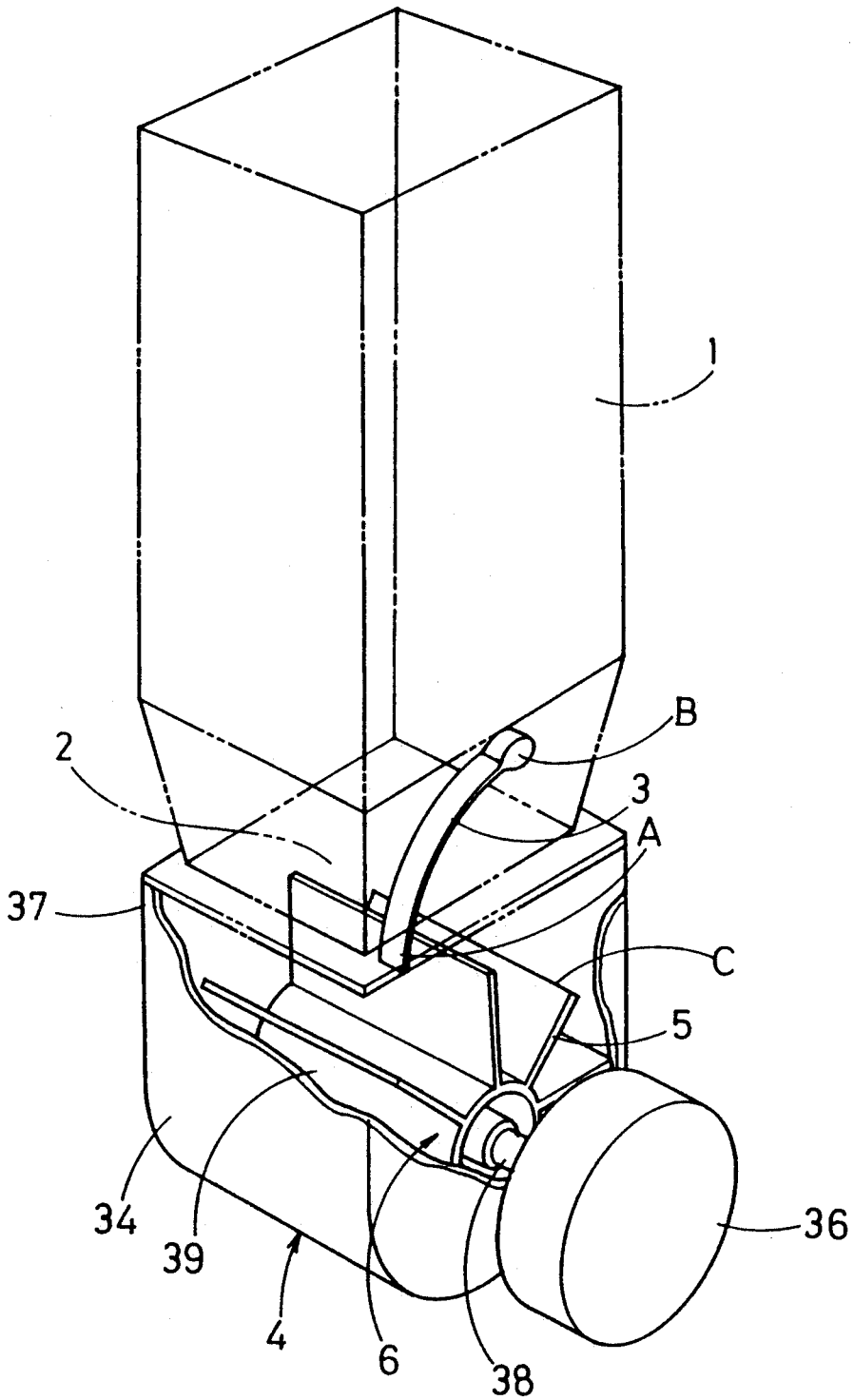
FIG. 8 is a perspective view of a further embodiment.

The tip of the vibrating member 3 may be allowed to be expanded, as shown in FIG. 8, larger than the member 3 proper, thereby increasing the impact to the toner cartridge.

As apparent by the above description, the present invention has an advantage that a vibrating member having an elasticity is provided in which the end A thereof is mounted to the rotating part in the toner conveying section and which has a size such that the other end B thereof extends far beyond the tip of the blade of the rotating part, whereby the rotation of the rotating part causes the other end B of the vibrating member to collide with the opening or inner wall of the toner cartridge so as to drop a toner efficiently, prevent the toner from being blocked, and reduce noise.

The vibrating member repulses in the rotating direction by the restoration force of the repulsing force stored therein, whereby the other end B can give a larger impact to the opening or inner wall of the toner cartridge, making better the toner dropping efficiency.

What is claimed is:

1. A toner hopper having a toner conveying section for supplying a toner, wherein toner from an adjacent toner cartridge is provided to the toner conveying section, and then outside of the toner hopper through an exit in the toner conveying section, comprising:

a vibrating member having an elasticity, an end (A) of the vibrating member being mounted to a rotating part in said toner conveying section, said vibrating member having a size such that an other end (B) thereof extends beyond a tip of a blade of said rotating part, wherein a rotation of said rotating part causes said other end (B) of said vibrating member to collide with a first edge of an opening part of said toner cartridge or a first inner wall of said toner cartridge, and said toner being sent from said toner cartridge into said toner conveying section through said opening part.

2. A toner hopper in accordance with claim 1, wherein:

said end (A) is attached to a hub of said rotating part.

3. A toner hopper in accordance with claim 1, wherein:

said end (A) is attached to the blade of said rotating part.

4. A toner hopper in accordance with claim 1, wherein:

said vibrating member rotates with the other end (B) bent in a direction opposite to that of said rotation.

5. A toner hopper in accordance with claim 1, wherein:

a tip of said vibrating member is expanded larger than said vibrating member proper, thereby increasing the strength of the collision.

6. A toner hopper in accordance with claim 1, wherein:

said vibrating member is held in a holding condition by a second inner wall of said toner conveying section or by a second edge of said opening part of said toner cartridge to save a repulsing force, and when said vibrating member passes through an opening of said toner cartridge, the holding condition of the vibrating member is released, and whereby said vibrating member repulses in a rotating direction by a restoration force to collide with said first inner wall of said toner cartridge or with the first edge of the opening part to give an impact.

7. A toner hopper in accordance with claim 1, wherein:

said vibrating member is held in a holding condition by an abutting member provided near said opening of said toner cartridge to save a repulsing force, and when said vibrating member passes through said opening of said toner cartridge, the holding condition is released, and whereby said vibrating member repulses in a rotating direction by a restoration force to collide with said first inner wall of said toner cartridge or with the first edge of said opening part to give an impact.

8. A toner hopper in accordance with claim 7, wherein:

said abutting member is fixed to said toner cartridge or to said toner conveying section.

9. A toner hopper in accordance with claim 1, wherein:

said toner cartridge is disposed on said toner conveying section, said toner in said toner cartridge falls into said toner conveying section by gravity; by vibration of said toner cartridge caused by said collision of said vibrating member; or by said vibrating member passing through an opening in the toner cartridge to agitate and release toner present near said opening.

10. A toner hopper for supplying toner, comprising:

a toner cartridge including a first inner wall, and a first edge and a second edge defining an opening, wherein the toner cartridge includes a toner supply;

a toner conveying section mounted beneath the toner cartridge such that toner is supplied from the toner cartridge to the toner conveying section through the opening by gravity;

a rotating part mounted in the toner conveying section for dispensing toner from the toner conveying section through an opening defined in a wall of the toner conveying section, wherein the rotating part includes a blade;

a vibrating member having an elasticity, wherein a first end of the vibrating member is mounted to the rotating part in said toner conveying section, wherein the vibrating member has a size such that a second end thereof extends beyond a tip of the blade;

wherein rotation of the rotating part causes the second end of the vibrating member to collide with the first edge or the first inner wall of said toner cartridge, whereby the collision of the vibrating member with the first edge or the first inner wall vibrates the toner cartridge to thereby release toner which is adhered to walls of the toner cartridge.

11. A toner hopper in accordance with claim 10, wherein the first end of the vibrating member is attached to a hub of the rotating part.

12. A toner hopper in accordance with claim 10, wherein the first end of the vibrating member is attached to the blade of the rotating part.

13. A toner hopper in accordance with claim 10, wherein the vibrating member rotates with the second end bent in a direction opposite to a direction of rotation of the rotating member.

14. A toner hopper in accordance with claim 10, wherein a tip of the vibrating member is larger than the vibrating member proper, thereby increasing a strength of the collision of the vibrating member with the first wall or the first edge.

15. A toner hopper in accordance with claim 10, wherein the vibrating member is held in a holding condition by a second inner wall of the toner conveying section or by the second edge of said opening part of said toner cartridge to save a repulsing force, and when the vibrating member passes through the opening of the toner cartridge, the holding condition of the vibrating member is released, and thereby the vibrating member repulses in a rotating direction by a restoration force to collide with the first inner wall of the toner cartridge or with the first edge of the opening part to give an impact.

16. A toner hopper in accordance with claim 10, wherein the vibrating member is held in a holding condition by an abutting member provided near the opening of the toner cartridge to save a repulsing force, and when the vibrating member passes through the opening of the toner cartridge, the holding condition is released, and thereby the vibrating member repulses in a rotating direction by a restoration force to collide with the first inner wall of the toner cartridge or with the first edge of the opening part to give an impact.

17. The toner hopper in accordance with claim 16, wherein the abutting member is fixed to the toner cartridge or to the toner conveying section.

* * * * *